US007089773B2

(12) United States Patent
Paulsen et al.

(10) Patent No.: US 7,089,773 B2
(45) Date of Patent: Aug. 15, 2006

(54) APPARATUS AND METHOD FOR FORMING AN ELONGATED ARTICLE

(75) Inventors: Frode Paulsen, Gjøvik (NO); Sigmund Røe, Gjøvik (NO)

(73) Assignee: Norsk Hydro ASA, Oslo (NO)

( * ) Notice: Subject to any disclaimer, the term of this patent is extended or adjusted under 35 U.S.C. 154(b) by 0 days.

(21) Appl. No.: 10/344,045

(22) PCT Filed: Aug. 10, 2001

(86) PCT No.: PCT/NO01/00337

§ 371 (c)(1),
(2), (4) Date: Jul. 21, 2003

(87) PCT Pub. No.: WO02/13988

PCT Pub. Date: Feb. 21, 2002

(65) Prior Publication Data

US 2004/0011114 A1 Jan. 22, 2004

(30) Foreign Application Priority Data

Aug. 11, 2000 (NO) ..... 20004059

(51) Int. Cl.
*B21D 7/00* (2006.01)

(52) U.S. Cl. ..... 72/303; 72/306; 72/295

(58) Field of Classification Search ..... 72/295, 72/306, 307, 296, 303, 301, 153, 159
See application file for complete search history.

(56) References Cited

U.S. PATENT DOCUMENTS

| | | | | |
|---|---|---|---|---|
| 2,887,143 | A * | 5/1959 | Ahonen | 72/21.3 |
| 3,452,574 | A * | 7/1969 | Mackenzie | 72/297 |
| 3,832,879 | A * | 9/1974 | Holden | 72/383 |
| 4,630,459 | A | 12/1986 | Elliott | |
| 4,735,075 | A | 4/1988 | Saegusa | |
| 4,941,338 | A * | 7/1990 | Spath | 72/151 |
| 4,945,747 | A * | 8/1990 | Yogo | 72/306 |
| 5,119,533 | A * | 6/1992 | Shimokata | 29/402.19 |
| 5,848,546 | A * | 12/1998 | Allison et al. | 72/296 |
| 6,237,380 | B1 * | 5/2001 | Kanamori | 72/14.8 |
| 6,612,143 | B1 * | 9/2003 | Butscher et al. | 72/21.4 |

FOREIGN PATENT DOCUMENTS

| | | |
|---|---|---|
| DE | 4432041 | 3/1996 |
| DE | 19717232 | 10/1998 |
| JP | 11-156446 | 6/1999 |

* cited by examiner

*Primary Examiner*—Daniel C. Crane
(74) *Attorney, Agent, or Firm*—Wenderoth, Lind & Ponack, L.L.P.

(57) ABSTRACT

An Apparatus and method for forming elongated metal articles includes one or more rotating dies (1) each provided with an indentation (3). The indentation (track) is shaped so as to be complementary to the actual final shape of the resulting articles, and the dies (1) are designed and adapted to ensure/allow three rotational degrees of freedom under deformation by rotation of the dies.

18 Claims, 2 Drawing Sheets

APPARATUS AND METHOD FOR FORMING AN ELONGATED ARTICLE

BACKGROUND OF THE INVENTION

The present invention relates to an apparatus and method for forming an elongated metal article and, more particularly, to an apparatus and method allowing three-dimensional forming of articles in a single one step process.

Numerous patent publications are known disclosing apparatuses and associated methods of forming elongated articles in multistage processes to convert, for example, extruded tubular Al-shapes into finished articles of desired configuration by stretching of the Al-shapes beyond the yield point of the material and subsequently/simultaneously employing a set of dies resulting in bending of the shapes.

However, all the hitherto known apparatuses do not assure a reliable, precise and economical manufacturing of three-dimensionally reshaped articles in one single operation without need for exchange and/or use of additional forming means (tools).

SUMMARY OF THE INVENTION

Consequently, it is an object of the present invention to provide a novel, effective method for forming of elongated metal articles, particularly three-dimensional forming, in one single operation.

Another object of the present invention is to provide a novel, effective integrated apparatus without need for additional forming means.

These and other objects and advantages of the novel apparatus and method of forming according to the present invention are met by provision of an apparatus and associated method of manufacturing as described herein.

BRIEF DESCRIPTION OF THE DRAWINGS

The invention will now be described in more detail by way of example(s) of preferred embodiment(s) of the apparatus and a preferred mode of operation and illustrated by the accompanying drawings, FIGS. 1–2, in which.

DETAILED DESCRIPTION OF THE INVENTION

The forming apparatus according to the present invention has basically four degrees of freedom: Rotation about three axes and translation in one direction to optionally reduce or increase the length of the article to be formed. The apparatus may be extended to have three rotational degrees of freedom and three transitional degrees of freedom (orthogonal/Cartesian system). The additional translation may help forming of complex parts or impose shear deformations. The principle utilized by this apparatus is to fix each end of the elongated metal article to the die. By moving the dies simultaneously/non-simultaneously along one or more of the rotational axes and/or by translating them, the starting profile/shape is gradually forced into a track (this die part is replaceable, so that the equipment is flexible) in the die determining the final shape of the product. It is important to stress that dies may be moved in everything from one to six of the degrees of freedom during a forming operation. It is also possible to alter the sequence of the movements of the dies and to suppress one or more of the degrees of freedom, depending on what is needed for the product to be produced.

Figure 1:
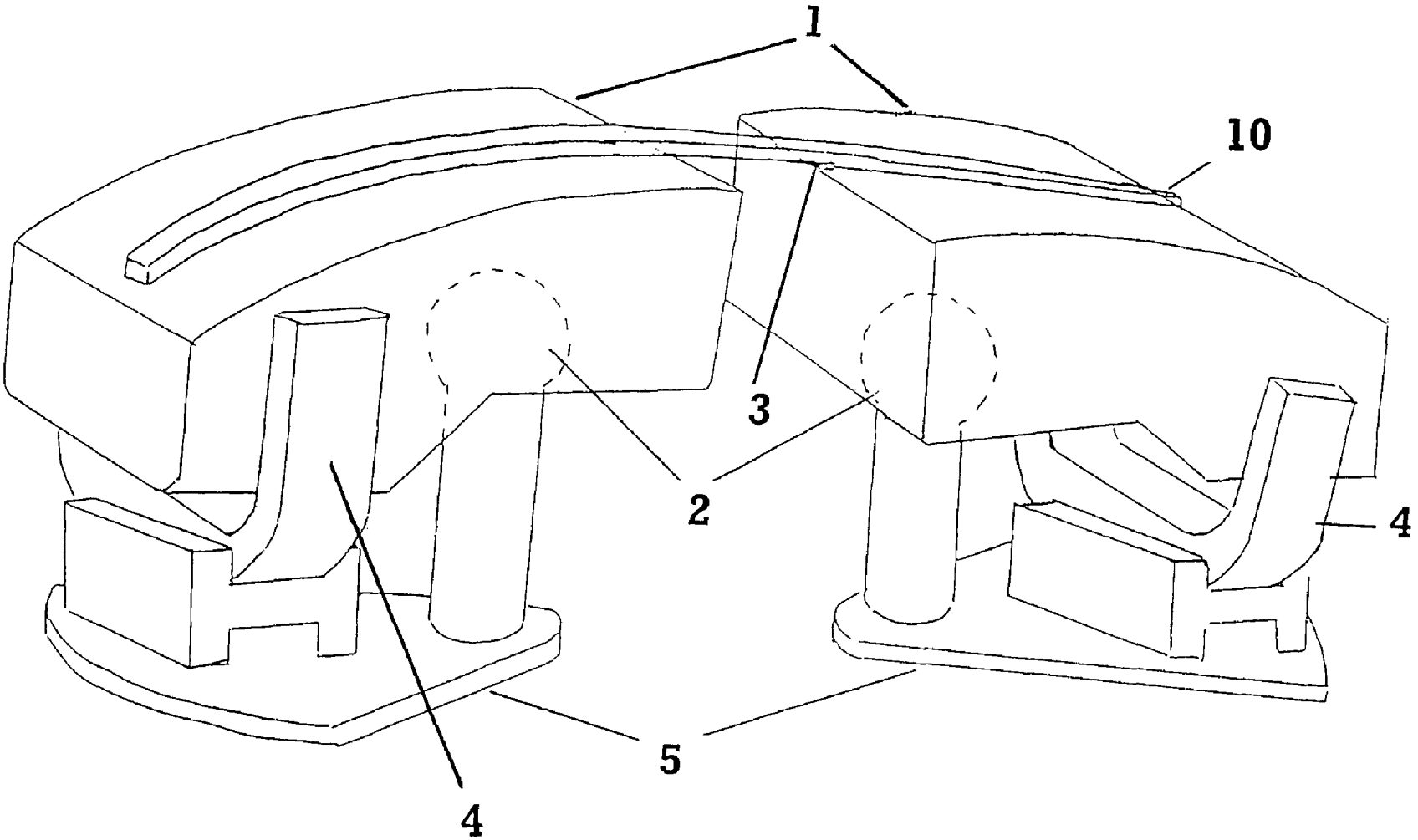
FIG. 1 is a perspective view showing the operational principle of applying a novel apparatus according to the present invention.

The rotational degrees of freedom may be provided/ensured simply by movements around a spherical joint as illustrated in FIG. 1. However, according to another preferred embodiment of the apparatus it is also possible to separate each of the rotational degrees of freedom into independent or dependent movements having a common or a non-common center of rotation, or they may be a combination of translations and rotations. In other words, one or more of the rotational degrees of freedom may be dependent on other movements as shown in FIG. 2.

Referring to the drawings, and particularly to FIG. 1, the surface of each of first and second die 1 is provided with an indentation or track 3 corresponding to the final form of the product. As illustrated in the drawings (and, particularly, FIGS. 2A and 2B), the indentation has the form of an elongated groove extending toward the other (opposite) die. The section may be supported on one, two or three sides along the track (elongated groove) that are engaging into contact with the processed member 10 (profile, extrusions, metal part etc.). An initially straight member 10 is placed into the tool while the tool is in its upper position. By fixing the ends of the section either by a fastening member such as a press or another clamping arrangement (not shown in the Figure), it is possible to rotate the die(s) so that the section gradually is forced into the track (groove) 3 in the die. In the final forming step, the die will be in the position illustrated in FIG. 1. The rotation from the initial stage to the final stage may take place about three independent axes, to perform bending in the vertical plane, bending in the horizontal plane and twisting of the section. It is important to emphasize that the two dies are not restricted to make the same movement. In some cases, for example, it is possible to fix one of the dies, and just use one side of the tool to bend a section. The fixed die is just used to support the part of the section that is not to be changed during the forming operation.

Each die 1 includes an upper portion that is in contact with the product (track for the final product). The shown upper die portions each rest on a spherical bearing joint 2, allowing rotation about three axes. The shown die part is also supported by a shaping mechanism 4 that can be used to control the movement of the upper portion around the sphere. The whole apparatus is resting on plates 5 that can move back and forth on a lower plate (not shown in the Figure) so as to form a translational movement member. This allows the two main die parts to be moved away or towards each other, allowing for an increase or reduction in tension during the bending. In other words, each die 1 is operable to move in a direction substantially parallel to a longitudinal axis of the elongated metal article to be formed, so as to affect the tension forces applied to the object.

Figure 2A:
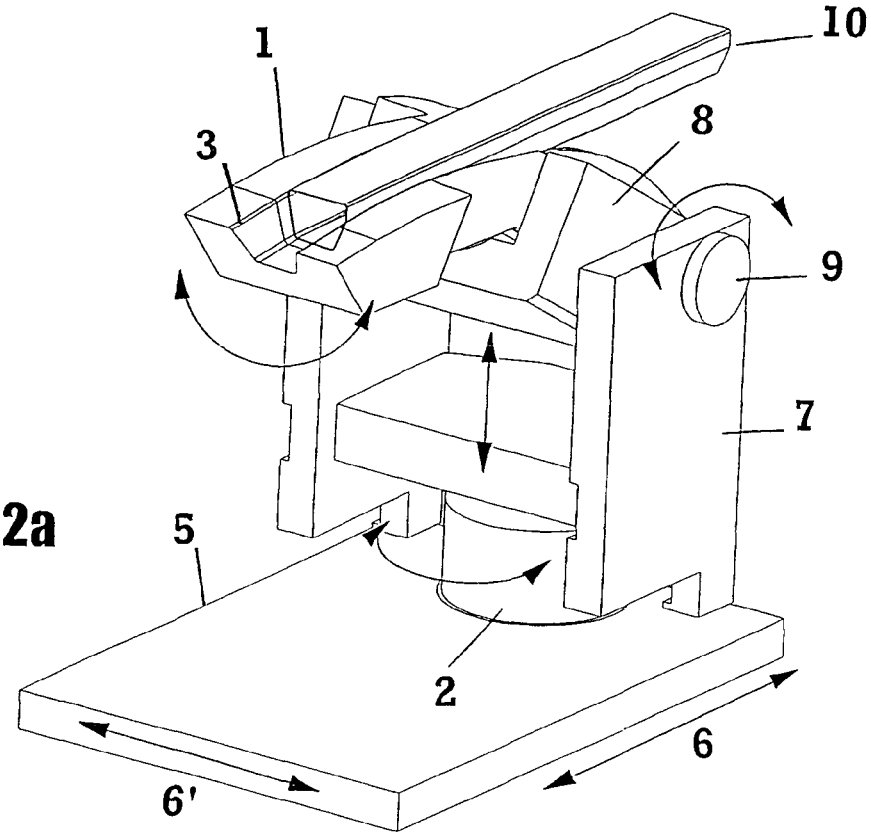
FIGS. 2*a*–*b* are perspective views showing a more detailed configuration of another embodiment of the novel apparatus applicable according to the present invention in the start and final position of the operation, respectively.

FIG. 2*a* illustrates schematically the preferred embodiment of the apparatus having four basic degrees of freedom separated in a start position of the (re)forming operation (only half of the apparatus is shown in the Figure). The base plate 5 can be moved back and forth to impose additional tension or compression into the article 10 to be bent. A cylindrical bearing 2 and its support 7 extending from the base plate 5 ensure rotation in a horizontal plane. A bolt 9 is mounted on the cylindrical bearing support to allow die rotations in a vertical plane of the die. The last movement, twisting (torsion) of the section, is performed inside a stiffener member 8 supporting the die 1 having a track 3 that is in contact with the elongated metal article to be formed 10. As noted above, the Figure only shows one half of the bending apparatus. Additionally, the translation movement indicated by 6 and 6' are possible degrees of freedom to impose shear deformation or to increase the complexity of the product to be formed.

Figure 2B:
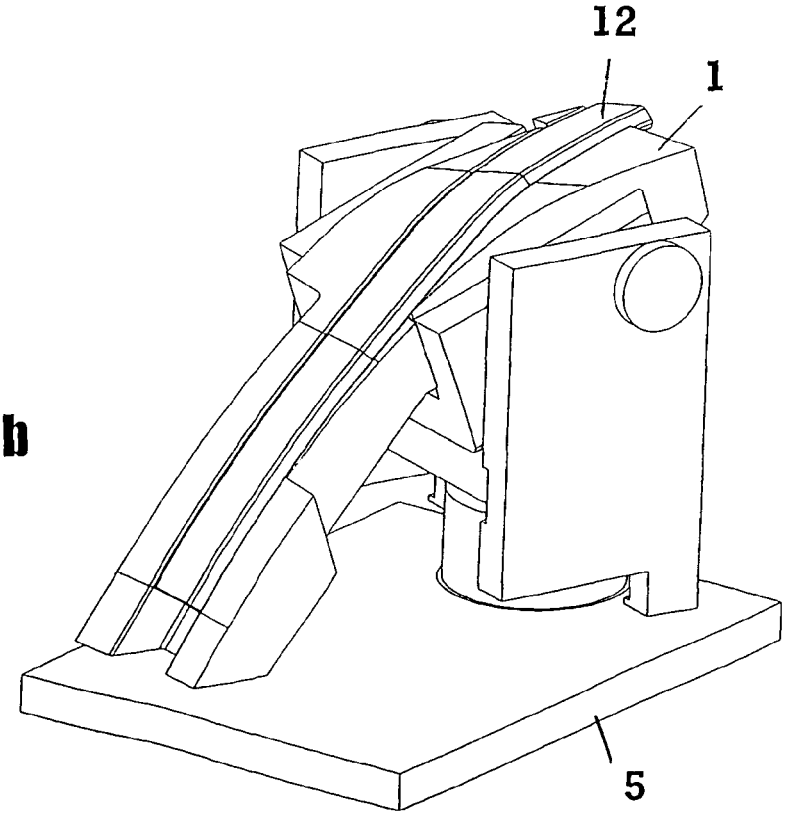

FIG. 2*b* is a partial perspective view schematically showing the apparatus in final position after termination of the bending/stretching operation with the die 1 resting on the base plate 5.

The original extruded article 10 from FIG. 2*a* is now converted/translated into a final product 12 (only half of the product is shown in the Figure) having the desired outer configuration.

Thanks to the novel apparatus according to the present invention, which offers mutually independent movement of the dies and thus completely independent degrees of movement freedom along a predetermined path for the respective ends of the shaped metal articles, more intricate complete configurations of the articles can be provided in one single (re)forming operation. The dies may, but do not need to, rotate along certain axes rotating in the latter case around one or more points.

The movements may be controlled by any known powering mechanism (i.e., hydraulically, electrically, or mechanically initiated movement). It is also possible to place the tool inside a press and let the movement of the press determine the die movements. The latter may also open for additional tool parts placed together with the proposed forming tool to make holes, imprints and so on.

The invention claimed is:

1. An apparatus for forming elongated metal articles, comprising:

at least one rotating die, each of said at least one rotating die having an indentation with a shape complementary to a final shape of the elongated metal article to be formed, and each of said at least one rotating die further having three rotational degrees of freedom and being operable to move independently of each other; and a fastening member for fixing the metal article to said at least one rotating die prior to a forming operation;

wherein each of said at least one rotating die includes an upper portion having said indentation, and includes a spherical bearing supporting said upper portion so as to allow the three rotational degrees of freedom.

2. The apparatus of claim 1, further comprising a translational movement member for moving each of said at least one rotating die in a direction parallel to a longitudinal axis of the elongated metal article to be formed, so as to apply tension or compression to the article.

3. The apparatus of claim 1, wherein each of said at least one rotating die includes one spherical bearing, each spherical bearing comprising one spherically-shaped ball engaging said upper portion.

4. The apparatus of claim 1, wherein each of said at least one rotating die further includes a shaping mechanism for controlling a movement of said upper portion about said spherical bearing.

5. A method of forming elongated metal articles, comprising:

positioning and fastening an elongated metal object onto rotatable dies, each of the rotatable dies having an indentation and three rotational degrees of freedom, and the rotatable dies being operable to move independently of each other;

rotating the rotatable dies so as to gradually force the metal object into the indentation of each of the dies;

stretching and simultaneously bending the metal object by mutually independent rotation of the rotatable dies in one or two planes; and terminating said stretching and simultaneous bending, and releasing the re-shaped metal object.

6. The method of claim 5, further wherein said stretching and simultaneous bending of the metal object includes moving the rotatable dies away from or toward each other so as to apply tension or compression to the metal object.

7. The method of claim 5, wherein said rotating of the rotatable dies comprises moving an upper portion of each of the rotatable dies about a spherical bearing, the upper portion of each of the rotatable dies having the indentation formed therein.

8. The method of claim 5, wherein all movements of the dies are controlled by vertical movement of a shaping mechanism.

9. An apparatus for forming an elongated metal article, comprising:

a first die and a second die spaced apart from each other, each of said first die and said second die having an elongated groove for receiving and holding the elongated metal article to be formed, said elongated groove of each of said first die and said second die extending toward the other of said first die and said second die, at least one of said first die and said second die being operable to be moved and having three orthogonal rotational degrees of freedom; and a fastening member for fixing the elongated metal article to said first die and said second die prior to a forming operation.

10. The apparatus of claim 9, wherein said at least one of said first die and said second die is further operable to be moved in a direction parallel to a longitudinal axis of the elongated metal article to be formed so as to apply tension or compression to the elongated metal article.

11. The apparatus of claim 9, wherein each of said first die and said second die is operable to be moved away from or toward the other of said first die and said second die so as to apply tension or compression to the elongated metal article.

12. The apparatus of claim 9, wherein each of said first die and said second die includes an upper portion having said elongated groove, a stiffener member supporting said upper portion so as to allow a torsional degree of freedom, and a cylindrical bearing supporting said upper portion so as to allow a horizontal degree of freedom.

13. The apparatus of claim 12, further comprising a translational movement member for moving each of said first die and said second die in a direction parallel to a longitudinal axis of the elongated metal article to be formed so as to apply tension or compression to the elongated metal article.

14. The apparatus of claim 9, further comprising a translational movement member for moving each of said first die and said second die in a direction parallel to a longitudinal axis of the elongated metal article to be formed so as to apply tension or compression to the elongated metal article.

15. The apparatus of claim 9, wherein said first die and said second die are operable to move independently of each other.

16. The apparatus of claim 15, wherein each of said first die and said second die has three orthogonal rotational degrees of freedom.

17. The apparatus of claim 16, wherein each of said first die and said second die is operable to be moved away from or toward the other of said first die and said second die so as to apply tension or compression to the elongated metal article.

18. The apparatus of claim 9, wherein said at least one of said first die and said second die is operable to be moved away from or toward the other of said first die and said second die so as to apply tension or compression to the elongated metal article.

* * * * *